United States Patent [19]

Kruesi et al.

[11] 4,311,520

[45] Jan. 19, 1982

[54] PROCESS FOR THE RECOVERY OF NICKEL, COBALT AND MANGANESE FROM THEIR OXIDES AND SILICATES

[75] Inventors: Paul R. Kruesi, Golden; Veryl H. Frahm, Jr., Boulder, both of Colo.

[73] Assignee: Cato Research Corporation, Wheat Ridge, Colo.

[21] Appl. No.: 125,465

[22] Filed: Feb. 28, 1980

[51] Int. Cl.[3] ..... C22B 47/00; C22B 4/00

[52] U.S. Cl. ..... 75/80; 75/10 R; 75/82; 219/10.55 R; 219/10.55 A; 423/49; 423/138; 423/150

[58] Field of Search ..... 75/80, 82, 10–12; 219/10.55 R, 10.55 A, 10.55 M; 423/49, 138, 150

[56] References Cited

U.S. PATENT DOCUMENTS

| | | | |
|---|---|---|---|
| 3,171,009 | 2/1965 | Scheller | 219/10.55 R |
| 4,049,438 | 9/1977 | Sridhar | 75/80 |
| 4,123,230 | 10/1978 | Kirkbride | 423/358 |
| 4,152,120 | 5/1979 | Zavitsanos | 44/1 |
| 4,162,916 | 7/1979 | Septier | 75/80 |
| 4,180,718 | 12/1979 | Hanson | 219/10.55 R |
| 4,221,680 | 9/1980 | Hardwick | 219/10.55 R |

*Primary Examiner*—P. D. Rosenberg

*Attorney, Agent, or Firm*—Sheridan, Ross, Fields & McIntosh

[57] ABSTRACT

A process for the recovery of nickel, cobalt or manganese from their oxides or silicates wherein such process, which requires the application of heat, is improved by utilizing microwave energy as the source of heat. The microwave energy may be utilized to cause the reduction of these values enabling such reduced values to then be recovered by conventional leaching processes. The microwave energy may also be used in conjunction with the chlorination of such values to produce their chlorides which are subsequently separated from the gangue and then processed by conventional means to obtain the metal values.

19 Claims, No Drawings

PROCESS FOR THE RECOVERY OF NICKEL, COBALT AND MANGANESE FROM THEIR OXIDES AND SILICATES

DESCRIPTION

1. Technical Field:

The process of the present invention relates to the use of microwave energy in the recovery of nickel, cobalt and manganese from their oxides and silicates.

2. Background Art and Prior Art Statement:

Nickel and cobalt have been recovered by a number of processes from laterite deposits which contain these metals as oxides or silicates. Because of the low content of about 1 to 2 percent nickel and about 0.05 to 0.2 percent cobalt, the processes which are used for such recovery are very expensive and very energy intensive. Examples of such economic and energy expensive techniques include the melting and reduction of the ore in an electric furnace to produce a ferronickel-cobalt alloy and a molten slag. Another such technique involves the selective reduction of the nickel and cobalt to their metals by reducing gases at high temperatures in the presence of large amounts of iron. The nickel and cobalt are then selectively dissolved with ammonia-ammonium carbonate.

Nickel, cobalt and manganese also occur in sea nodules found in deep ocean deposits. A variety of processes have been proposed for treating these nodules. These processes, too, involve high temperature or expensive reagents. Manganese, sometimes associated with cobalt, also occurs as veinlets and nodules in decomposed quartzites. However, because of the low manganese content of less than about 20 percent and cobalt content of 0.5 percent or lower, these deposits are not currently considered economical.

U.S. Pat. No. 2,733,983 to Daubenspeck teaches the use of ferric chloride at high temperatures of 600° C. to 700° C. to chlorinate nickel and cobalt oxides. U.S. Pat. No. 4,144,056 to Kruesi discloses heating a metal oxide or silicate in the absence of air with ferric chloride and a volatility depressant salt selected from the group consisting of alkali metal chlorides and ammonium chlorides for a time of about 30 minutes to about 1 hour at temperatures of from about 200° C. to about 600° C.

U.S. Pat. No. 4,123,230 and 4,148,614, both to Kirkbird, disclose the desulfurization of coal by subjecting the coal or a slurry of coal particles in a hydrogen atmosphere to microwave energy. U.S. Pat. No. 4,152,120 to Zavitsanos, et al, removes pyrite and organic sulfur from coal through the use of alkali metal or alkaline earth compounds and low amounts of microwave energy. These patents teach microwave energy as being useful in the treatment of coal but do not indicate the treatment of oxides or silicates.

Microwaves are well-known for their use in radar and communication transmissions. They have also been extensively used as a source of energy for cooking food. Although microwaves have been studied for many years and put to practical uses, the effect which they have on many materials is not known. The effect of microwaves upon many ores and minerals is not known nor can it be readily predicted. The effect of microwaves upon metal values contained within ores does not appear to be related in any simple way to the chemical or physical properties of such metal values. For example, nickel, cobalt and manganese oxides absorb microwaves, but iron oxide and chromium oxide, which are also transition metals, do not absorb microwaves.

In treating nickel, cobalt and manganese ores it is only the nickel, cobalt and manganese values which are heated; the gangue of the ore does not appreciably absorb microwave radiation. None of the prior art recognizes the ability of the oxides and silicates of nickel, cobalt and manganese to absorb microwaves or the fact that the gangue is low absorbant, transparent to and/or reflective of the microwave energy.

DISCLOSURE OF THE INVENTION

Microwave energy is used in processes requiring heat to recover the metals nickel, cobalt and manganese from their oxides and silicates. The microwave energy is used in conventional processes for the recovery of these metals from their oxide and silicate ores in place of conventional heat sources. The microwave energy heats only the metal values and in certain cases the reagents. It does not affect the temperature of the gangue or of iron oxides which may be present. Thus, the use of microwaves for the recovery of such metal values results in an overall reduction of energy required for such processes, especially when the metal values are being recovered from low grade ores, such as laterite or saprolite, or from sea nodules.

Depending upon the process used for the recovery of these metals, the metal values may be first reduced and then treated by conventional means to recover the values or they may be treated directly. Reduction is accomplished through the application of microwave energy to the ore containing the metal value until the metal value reaches a temperature of from about 500° C. to about 800° C. in the presence of a reducing atmosphere consisting of hydrogen, carbon monoxide, hydrocarbon gases, sulfur, sulfur dioxide or mixtures thereof. After the reduction, the ore is then treated to recover the metal values. For example, it may be leached with an oxygenated ammonia-ammonium carbonate solution or with an inorganic acid such as hydrogen chloride, hydrogen bromide, nitric acid, phosphoric acid and sulfuric acid to obtain the desired metal values. The reduced ore can also be treated with chlorine or a chlorine source to obtain the chloride form of the metals and thereafter treated by electrolysis, cementation or other standard recovery procedures for the metals. Alternatively, ore containing nickel and/or cobalt may be heated in the absence of air to a temperature of from about 200° C. to about 600° C. by microwave energy in the presence of ferric chloride, cupric chloride or chlorine to cause the direct conversion of the metal values to their chlorides and the subsequent recovery of the metal from the metal chlorides by conventional techniques.

BEST MODE FOR CARRYING OUT THE INVENTION

The process of the present invention is applicable to the treatment of the oxides and silicates of nickel, cobalt and manganese and any sources thereof. It is useful in the recovery of such metals from their oxide and silicate ores, especially low grade ores, such as laterite and saprolite, and from sea nodules.

It is preferred that the source of the metal oxides and silicates be ground to a size of 12 mesh or smaller. The grinding is not necessary for the action of the microwave energy. It merely increases the surface area of the metal values available for reaction with the reagents.

Since many of the sources of these metal values, for example, laterite, saprolite, naturally occur as relatively small particles, grinding is not always necessary. Sea nodules are coarse and should be ground prior to processing them.

Prior to being subjected to microwave energy, it is preferred that the nickel, cobalt or manganese oxide or silicate feed material be dried from free moisture. It is not necessary that the material be absolutely dry or that the chemically combined water be removed. Water is a receptor of microwaves and its presence in large amounts is wasteful of the microwave energy. Thus, the removal of water increases the efficiency of heating with microwaves; however, its removal is not essential for the practice of the invention.

Microwave energy can be used in a variety of processes which require the heating of nickel, cobalt and manganese oxides or silicates in order to recover the nickel, cobalt and manganese values. Such processes include reduction, reduction with subsequent chlorination and direct chlorination of these values. The reduction of the metal values is accomplished by exposing the feed material to microwaves to obtain a temperature of from about 500° C. to about 800° C. in the presence of a reducing atmosphere. A preferred temperature range is from about 600° C. to about 750° C. Examples of reducing atmospheres include hydrogen, hydrocarbon gases, carbon monoxide, sulfur and sulfur dioxide. Hydrogen and carbon monoxide are preferred reductants.

Thereafter, the reduced material may be subjected to conventional techniques for the recovery of the metal values. Such techniques include, for example, the Caron process which entails leaching the material with an oxygenated ammonia-ammonium carbonate solution. A description of the Caron process is contained in "Fundamental and Practical Factors in Ammonia Leaching of Nickeliferous Laterites", *Trans. AIM,* Vol. 188, pp. 67–90 (1950). The oxygenated ammonia-ammonium carbonate dissolves the nickel and cobalt metals. Thereafter, the metals of nickel and cobalt may be recovered by precipitation or by solvent extraction. The metal values may also be obtained by subjecting the cooled reduced metal bearing material to a leach with an inorganic acid such as hydrochloric acid, hydrobromic acid, nitric acid, phosphoric acid and sulfuric acid. Such a method is described in U.S. Pat. No. 3,903,241. A preferred inorganic acid is hydrochloric acid.

Alternatively, the reduced metal bearing material can be reacted with chlorine or a chlorine source at a temperature of from about 200° C. to about 600° C. to convert the metal values to their chloride forms. When ferric chloride is used as a source of chlorine, then the reaction temperature should not exceed 600° C. in order to reduce the volatilization of the ferric chloride and to avoid the formation of magnetite and ferrous oxide. Magnetite and ferrous oxide are much less favorable to the reaction of ferric chloride for forming nickel, cobalt and manganese chlorides. Temperatures less than 200° C. may be utilized; however, at temperatures less than 200° C. the chlorination reaction proceeds at a much slower rate making such temperatures impractical. After chlorination, the metal chlorides are dissolved from the residue and the metals recovered from their chloride solutions by electrolysis, cementation or other conventional recovery procedures.

When the metals are to be converted to nickel chloride or cobalt chloride, then no reduction is necessary prior to the chlorination step. However, prior reduction of the material may result in an enhanced chlorination of the nickel and cobalt. When manganese is to be converted to its chloride form, then reduction of the manganese to the +2 or +3 oxidation state is necessary in order for the manganese to react with the chlorine. When the metal bearing material is subjected directly to a chlorination process, it is preferred that the metal bearing material be heated to a temperature from about 200° C. to about 600° C. The parameters for chlorinating the metal bearing material are the same whether or not the metal bearing feed material has been reduced.

The chlorination is conducted in the absence of air and in the presence of chlorine or a chlorine source. The chlorine source is ferric chloride and/or cupric chloride. The chlorine or chlorine source is present in at least the stoichiometric amount needed for the chlorination of the metal values present. It is preferred that the chlorine or chlorine source not be used in an amount greater than about five times the stoichiometric amount needed to chlorinate the metal values. When the metal oxides or silicates are not first reduced prior to chlorination, then it is preferred that the chlorination be conducted in the presence of ferric chloride or cupric chloride. It is more preferred to conduct the chlorination in the presence of ferric chloride. The chlorination of the unreduced metal bearing material is much slower when conducted only in the presence of a chlorine gas atmosphere. Chlorine gas is a more efficient chlorinator when the metal bearing material has been reduced prior to the chlorination.

When ferric chloride is used, an alkali metal chloride or ammonium chloride may be added as a volatility depressant for the ferric chloride in order to enhance the conversion of the metals to their chlorides. When used, the volatility depressant is used in an amount of about 1 part of depressant to about 3 parts of ferric chloride. Because the reaction time is so short when microwaves are used, the volatilization of the ferric chloride is not nearly the problem it is in conventional processes of much longer reaction times. Thus, the presence of a volatility depressant is not a requirement for the operation of the present invention.

It is preferred to mix the metal bearing material with ferrous chloride, cuprous chloride or a chlorine source, i.e. ferric or cupric chloride, and then heat the metal bearing material with microwave energy in the presence of chlorine gas. Ferric chloride or cupric chloride will be formed in situ or the chlorine source will be maintained causing the chlorination of the metal bearing material. When the metal bearing material is to be chlorinated subsequent to a reduction step, then it is preferred to mix ferrous or cuprous chloride with the ore prior to reduction and reduce the metal bearing material. Thereafter, upon any needed adjustment of the temperature of the metal bearing material and the addition of chlorine gas to the reactor, the chlorination will take place.

Although a chlorine atmosphere is preferred in a chlorination process utilizing ferric chloride or cupric chloride, where such an atmosphere is inconvenient, then the reaction can be carried out in any oxygen-free atmosphere such as nitrogen or an inert gas. When ferric or cupric chloride is not present, then a chlorine gas atmosphere must be present.

After the chlorination, the material may be leached to recover the nickel, cobalt and manganese chlorides. A number of means are known to those in the art for separating these metal chlorides and putting them in useful form. For example, the metal chlorides may be separated from the gangue by leaching the metal bearing material with water and thereafter separating the metal chlorides through electrolysis or precipitation as sulfides.

Microwaves are that portion of the electromagnetic spectrum which extends from 300 megahertz to $1.4\times10^6$ megahertz. In the United States four frequencies of microwave heating have been allocated for industrial, scientific and medical use. These frequencies are 915±25 megahertz, 2,450±50 megahertz, 5,800±75 megahertz and 22,125±125 megahertz. Additional frequencies have been designated in other countries. As a matter of convenience, it is desirable to utilize frequencies which have been allocated for industrial, scientific and medical uses by the government. The absorbtion of microwave energy by a given material is a complex function which varies with frequency, and therefore response will vary over a range of frequencies. Because the shielding and prevention of stray radiation is simpler in the case of the longer wavelengths associated with the lower frequencies such as 915 megahertz and 2,450 megahertz these frequencies are preferred.

The microwave energy utilized in this invention excites and heats primarily the oxides and silicates of nickel, cobalt and manganese. It has little effect on the surrounding gangue or iron oxides which may be present. However, the gangue and any iron oxide present will be heated to the extent that heat is conducted from the nickel, cobalt and manganese oxides or silicates. Because the microwaves selectively heat only a small portion of the material being treated, much less energy is required for much shorter times, as compared to conventional processes. Since the iron oxides which may be present in the metal bearing material are not affected by the microwaves, they are not reduced to metallic iron or chlorinated, thereby eliminating the problems encountered in conventional processes in separating iron values from nickel, cobalt or manganese values.

Reaction times, i.e. the times for which the metal bearing materials are exposed to microwave energy, will depend upon the interaction of several different parameters including the particular material being heated, the amount of material, the wavelength or wavelengths of the microwave energy being applied and the power of the microwave energy. Generally, the greater the power of the microwave the shorter the heating time. The degree of absorption of the microwave energy is dependent upon the frequency of that energy. Moreover, with respect to heterogeneous materials, multiple frequencies of microwaves may be desirable to obtain a more uniform, in-depth heating of the ores. Thus, the desirability of the microwave frequency or frequencies and power(s) to be used are best determined by experimentation for a particular ore.

EXAMPLE 1

To determine the difference in absorption ability of different materials for microwaves, 25 gram samples of different materials were irradiated with microwaves at a frequency of 2,450 megahertz at 600 watts for 6 minutes. After irradiation the temperature of the materials was determined as rapidly as possible. The temperatures attained, which are only approximate, are given below in Table 1.

TABLE 1

| Material | 2450 mH °C. |
|---|---|
| Sand | 42 |
| $Fe_2O_3$ | 43 |
| $MnO_2$ | >500 |
| NiO | 360 |
| Cobalt Oxide | >500 |
| $Cr_2O_3$ | 46 |

EXAMPLE 2

Another series of the same samples of Example 1 were irradiated at a frequency of 915 megahertz at 260 watts. A supply of water to absorb excess radiation was present in all cases in a separate container to prevent damage to the generator by the lack of absorption of radiation by those materials which poorly absorb the microwave energy. After irradiation the temperature of the materials was determined as rapidly as possible. The temperatures attained, which are only approximate, are given below in Table 2.

TABLE 2

| Material | 915 mH °C. |
|---|---|
| Sand | 29 |
| $Fe_2O_3$ | 28 |
| $MnO_2$ | 38 |
| NiO | 51 |
| Cobalt Oxide | 38 |

EXAMPLE 3

Several 25 gram samples of a dried lateritic nickel cobalt ore which contain saprolite with 0.96 percent nickel and 0.114 percent cobalt were dried at 100° C. and then each were blended with 4 grams of ferric chloride and 2 grams of sodium chloride and then irradiated in an argon atmosphere with microwaves at 2,450 megahertz at 600 watts for different time intervals. Each sample was then leached in water for one half hour and the filtered solutions and residues assayed to determine the nickel and cobalt yield. The results are given below in Table 3.

TABLE 3

| Time of Irradiation (minutes) | Nickel Yield (%) | Cobalt Yield (%) |
|---|---|---|
| 0 | 1.3 | 8.3 |
| 1 | 5.4 | 10.3 |
| 2 | 20.8 | 37.9 |
| 4 | 58.0 | 62.0 |
| 8 | 70.8 | 68.9 |
| 16 | 33.3 | 41.4 |

EXAMPLE 4

A 25 gram sample of the same type of laterite ore used in Example 3 was dried at 100° C. and then blended with 4 grams of ferric chloride and 2 grams of sodium chloride. The sample was then irradiated with microwaves at 2,450 megahertz at 600 watts for 8 minutes in a chlorine atmosphere. The sample was then leached with water and the yield of nickel was found to be 75 percent and the yield of cobalt 69 percent. The weight of the residue was 94 percent of the weight of the initial feed.

EXAMPLE 5

A 20 gram sample of the same type of laterite ore used in Example 3 was blended with a solution containing 2 grams of iron as ferrous chloride and then dried at 100° C. The dried material was then irradiated with microwaves at 2,450 megahertz at 600 watts for 4 minutes in a hydrogen atmosphere and then cooled to room temperature. Thereafter the sample was irradiated with microwaves at 2,450 megahertz at 600 watts for 4 minutes in a chlorine atmosphere. The reduced sample was leached with water and 82 percent of the nickel and 79 percent of the cobalt were recovered as their chlorides.

EXAMPLE 6

A 25 gram sample of the same type of laterite ore used in Example 3 was dried at 100° C. and then blended with 4 grams of ferric chloride and irradiated with microwave energy at 2,450 megahertz at 600 watts for 8 minutes in an inert atmosphere. The recovery of nickel and cobalt as their chlorides via a water leach was 71 and 78 percent, respectively.

EXAMPLE 7

A 25 gram sample of a low grade laterite ore containing 0.74 percent nickel and 0.06 percent cobalt was blended with 4 grams of ferric chloride and 2 grams of sodium chloride and irradiated with microwave energy at 2,450 megahertz at 600 watts for 4 minutes in an inert atmosphere. Sixty percent of the nickel and 70 percent of the cobalt as their chlorides were recovered from the residue.

EXAMPLE 8

A 33.4 gram sample of manganese nodules and manganese encrustation coatings on quartzite, which contained 15 percent manganese and 0.4 percent cobalt, was ground to a minus 30 mesh. The sample was heated by microwaves having a frequency of 2,450 megahertz at 600 watts for 4 minutes in an atmosphere of flowing hydrogen. The reduced manganese-cobalt material was then blended with 15.4 grams of ferric chloride and 5.1 grams of sodium chloride and irradiated again at the same frequency and power of microwave energy for 3 minutes in a chlorine atmosphere. The solid was then leached with water and 65 percent of the manganese and 47 percent of the cobalt were recovered as their chlorides.

EXAMPLE 9

A 40 gram sample of the same type of laterite ore used in Example 3 was irradiated with microwaves having a frequency of 2,450 megahertz at 600 watts for 5 minutes in a hydrogen atmosphere. The material was then leached in 250 milliliters of 1 normal hydrochloric acid for 2 hours and 14 percent of the nickel and 47 percent of the cobalt were dissolved in the acid.

What is claimed is:

1. In a process for the recovery of a metal selected from the group consisting of nickel, cobalt and manganese from an ore material comprising an oxide or silicate of said metal and gangue, wherein the recovery process utilizes heat, the improvement in combination therewith comprising the step of subjecting said ore material to microwave energy wherein said microwave energy is preferentially absorbed by the metal oxide or silicate over the gangue and wherein the process involves a chemical reaction of the metal oxide or silicate.

2. The process of claim 1 wherein the metal oxide or silicate is heated with microwave energy to cause the reduction of the metal oxide or metal silicate.

3. The process of claim 2 wherein the metal oxide or metal silicate is heated with microwave energy to obtain a temperature of from about 500° C. to about 800° C. in the presence of a reducing gas.

4. The process of claim 3 wherein the reducing gas is selected from the group consisting of hydrogen, hydrocarbon gases, carbon monoxide, carbon, sulfur, sulfur dioxide and mixtures thereof.

5. The process of claim 4 wherein the reduced metal values are recovered by an oxygenated ammonia-ammonium carbonate leach.

6. The process of claim 4 wherein the reduced metal values are recovered by an inorganic acid leach.

7. The process of claim 4 wherein the reduced metal values are converted to their chloride form.

8. The process of claim 7 wherein the reduced metal values are heated in the absence of oxygen via microwave energy to a temperature of from about 200° C. to about 600° C. in the presence of a source of chlorine selected from the group consisting of ferric chloride, cupric chloride and mixtures thereof.

9. The process of claim 1 wherein the source of the metal oxide or metal silicate is an ore.

10. The process of claim 9 wherein the ore is selected from the group consisting of laterites, saprolites and sea nodules.

11. In a process for the recovery of a metal selected from the group consisting of nickel, cobalt and manganese from an ore material comprising an oxide or silicate of said metal and gangue, wherein the metal values are converted to their metal chlorides, the improvement comprising supplying heat needed to effect such a chlorination via microwave energy wherein said microwave energy is preferentially absorbed by the metal oxide or silicate over the gangue.

12. A process for the recovery of a metal selected from the group consisting of nickel, cobalt and manganese from an ore material comprising an oxide or silicate of said metal and gangue, comprising heating the metal oxide or metal silicate in an oxygen-free atmosphere with microwave energy to a temperature of from about 200° to about 600° C. in the presence of a source of chlorine in order to obtain the metal chloride wherein said microwave energy is preferentially absorbed by the metal oxide or silicate over the gangue.

13. The process of claim 12 wherein the metal oxide or metal silicate is first reduced by heating it to a temperature of from about 500° C. to about 800° C. in a reducing atmosphere selected from the group consisting of hydrogen, hydrocarbon gases, carbon monoxide, carbon, sulfur, sulfur dioxide and mixtures thereof.

14. The process of claim 12 or claim 13 wherein the source of chlorine is selected from the group consisting of chlorine gas, ferric chloride, cupric chloride and mixtures thereof.

15. The process of claim 14 wherein the chlorine source is ferric chloride.

16. The process of claim 15 wherein a volatility depressant selected from the group consisting of alkali metal chlorides and ammonium chloride is added with the ferric chloride.

17. A process for the recovery of a metal selected from the group consisting of nickel, cobalt and manganese from an ore material comprising an oxide or silicate of said metal and gangue, wherein the metal values are converted to their chlorides comprising heating the metal oxide or metal silicate in an oxygen free atmosphere with microwave energy to a temperature of from about 200° C. to about 600° C. in the presence of ferric chloride and recovering the metal from its chloride form wherein said microwave energy is preferentially absorbed by the metal oxide or silicate over the gangue.

18. The process of claim 17 wherein the metal oxide or metal silicate is first reduced by heating it with microwave energy to a temperature of from about 600° C. to about 750° C. in the presence of a reducing gas selected from the group consisting of hydrogen, carbon monoxide and mixtures thereof, the reduced metal oxide or metal silicate is then cooled and subjected to the chlorination process.

19. The process of claim 17 or claim 18 wherein ferrous chloride is added to the metal oxide or metal silicate and the chlorination reaction is initiated by the addition of chlorine gas to cause the formation of ferric chloride.

* * * * *